US010865541B1

(12) United States Patent
Rhodine et al.

(10) Patent No.: US 10,865,541 B1
(45) Date of Patent: Dec. 15, 2020

(54) DIPPER HANDLE ASSEMBLY FOR A POWER SHOVEL

(71) Applicant: L & H Industrial, Inc., Gillette, WY (US)

(72) Inventors: Jordan T. Rhodine, Gillette, WY (US); Nathanael S. Hecht, Gillette, WY (US)

(73) Assignee: L&H INDUSTRIAL, INC., Gillette, WY (US)

( * ) Notice: Subject to any disclaimer, the term of this patent is extended or adjusted under 35 U.S.C. 154(b) by 0 days.

(21) Appl. No.: 16/743,802

(22) Filed: Jan. 15, 2020

Related U.S. Application Data

(60) Provisional application No. 62/798,199, filed on Jan. 29, 2019.

(51) Int. Cl.

| | |
|---|---|
| ***E02F 3/36*** | (2006.01) |
| ***E02F 3/42*** | (2006.01) |
| *E02F 3/02* | (2006.01) |

(52) U.S. Cl.
CPC ..... *E02F 3/3677* (2013.01); *E02F 3/427* (2013.01); *E02F 3/02* (2013.01)

(58) Field of Classification Search
CPC ..... E02F 3/3677
See application file for complete search history.

(56) References Cited

U.S. PATENT DOCUMENTS 3,425,574 A * 2/1969 Learmont ..... E02F 3/30 414/690

* cited by examiner

*Primary Examiner* — Gerald McClain
(74) *Attorney, Agent, or Firm* — FisherBroyles LLP; Ian R. Walsworth

(57) ABSTRACT

A yoke for a dipper handle assembly used on a power shovel. The yoke is constructed at least in part of a transition portion and associated lugs manufactured of a forged material as opposed to castings. Accordingly, the yoke is less prone to failure and easy to repair in the field.

19 Claims, 5 Drawing Sheets

DIPPER HANDLE ASSEMBLY FOR A POWER SHOVEL

This application claims the benefit of U.S. Provisional Patent Application No. 62/798,199, filed Jan. 29, 2019, the entirety of which being incorporated by reference herein.

FIELD OF THE INVENTION

Embodiments of the present invention are generally concerned with dipper handle assemblies used by power shovels. More specifically, an improved dipper handle yoke is disclosed.

BACKGROUND OF THE INVENTION

Power shovels, which are also known as stripping shovels, front shovels, electric mining shovels, or rope shovels, are common in the mining industry. FIG. 1 shows an example of a power shovel 1 manufactured by Caterpillar® as their Model 7495. The dipper 2, i.e. the shovel, is supported at an upper and by cables 6 operatively interconnect to a boom assembly 10. The boom assembly 10 is configured to selectively raise and lower the dipper 2, wherein the cables 6 control the dipper tilt angle. In operation, the dipper handle assembly 20 slides within the saddle block 24 to move the dipper 2 into a geological formation, which is commonly known as "crowding."

Power shovels employ either a rope crowd or a hydraulic crowd that moves the handle assembly 10 relative to the saddle block 24. The fundamental difference between the crowd configurations is that the rope crowd utilizes a wire rope 22 and the hydraulic crowd utilizes a hydraulic cylinder to move the handle assembly. In rope crowd configurations, handle assembly movement is accomplished by selectively tensioning a rope 22 positioned within the dipper handle assembly 20, which should be well understood by those of skill in the art.

The dipper handle assembly 20, generally comprises a tube 28 with a yoke 32 interconnected to one end thereof. The yoke 32 is operatively interconnected to a top portion of the dipper 2. The yoke is also interconnected to a bottom portion of the dipper 2 by way of a pitch brace 36. The upper connection allows the dipper to be selectively rotated when tension is applied to, or released from, the cables 6. The yoke is generally comprised of a transition portion interconnected on one end to the tube 28. An opposite end of the transition portion is interconnected to lugs that operatively interconnect to the dipper 2. The yoke also includes a plurality of stiffeners or connecting plates, the nature of which depends on the crowd configuration employed.

Again, the handle assembly, which is often referred to simply as a "handle" is used to urge the dipper 2 into a geological formation, such as a bank, to initiate material gathering. The handle assembly is an area of concern due to the harsh environment it is exposed to and the severe loading it experiences. More specifically, the transition portion experiences a combination of bending and axial loads as it is designed to distribute stresses from the lugs to the tube. Existing yokes consist of a large transition casting that routinely cracks as a result of the high forces it experiences. Manufacturer-supplied handle assemblies typically function 12,000 to 17,000 hours before crack repair is necessary. Once repaired, handle assemblies typically function for another 5,000 to 7,000 hours until they fracture and require a new yoke. Often, the tube can be salvaged and a maximum lifetime of about 24,000 to 30,000 hours can be achieved.

Those of ordinary skill in the art will appreciate that castings are not easily weld-repairable in the field, which results in costly and time-intensive handle assembly rebuild. Further, yokes often completely fail with no option but to replace the yoke and/or handle assembly.

Accordingly, is a long-felt need to provide a yoke with superior life and that is easy to repair. It is also desirable to provide a yoke that can be configured or modified to work with a rope or hydraulic crowd power shovel.

SUMMARY OF THE INVENTION

It is one aspect of some embodiments of the present invention to provide a yoke comprised of a forged transition portion and forged lugs interconnected by a plurality of plates. One advantage of this configuration is that the grain structure of the forged components can be precisely controlled to provide increased tensile strength and fatigue resistance. Those of ordinary skill in the art will appreciate yoke transition portions are traditionally cast because they possess areas of varying thicknesses and of complex shapes, which makes the component difficult to forge. Counter to conventional wisdom, embodiments of the present invention replace the previously-cast components with forgings to eliminate material defects inherent to casting processes. Accordingly, a yoke having a stronger transition portion is provided, wherein material grain structure is selectively controlled to coincide with the direction of typical yoke bending loads. Providing a yoke with forged components facilitates repair as preheat requirements are reduced and, thus, weldability is improved.

It is another aspect of some embodiments of the present invention to provide a yoke that can be used for hydraulic and rope crowd power shovels. More specifically, the yoke of one embodiment designed for rope crowd applications is configured to receive a forged insert that allows the yoke to be used with hydraulic crowding power shovels. The insert includes a bore for interfacing with an end of the hydraulic cylinder. One end of the insert abuts a shoulder provided within the yoke, wherein an opposite end is welded to an inner surface of the yoke. Because the insert is forged from the same material as the yoke, a continuous welding procedure can be employed that can be performed robotically. The insert provides a simple yet effective means of connecting the hydraulic cylinder while adding stiffness to a necked-down portion of the transition portion. An interference fit between the insert and the transition also resists fatigue caused by cyclical loading.

Plates form the remainder of the transition portion. Lugs for connecting to a dipper, which are manufactured as forgings rather than castings, are welded to the plates. The lugs experience significant stress and providing superior mechanical properties of forgings translates into increased fatigue life of the handle assembly, which minimizes costly crack repair castings require.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description hereinbelow.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
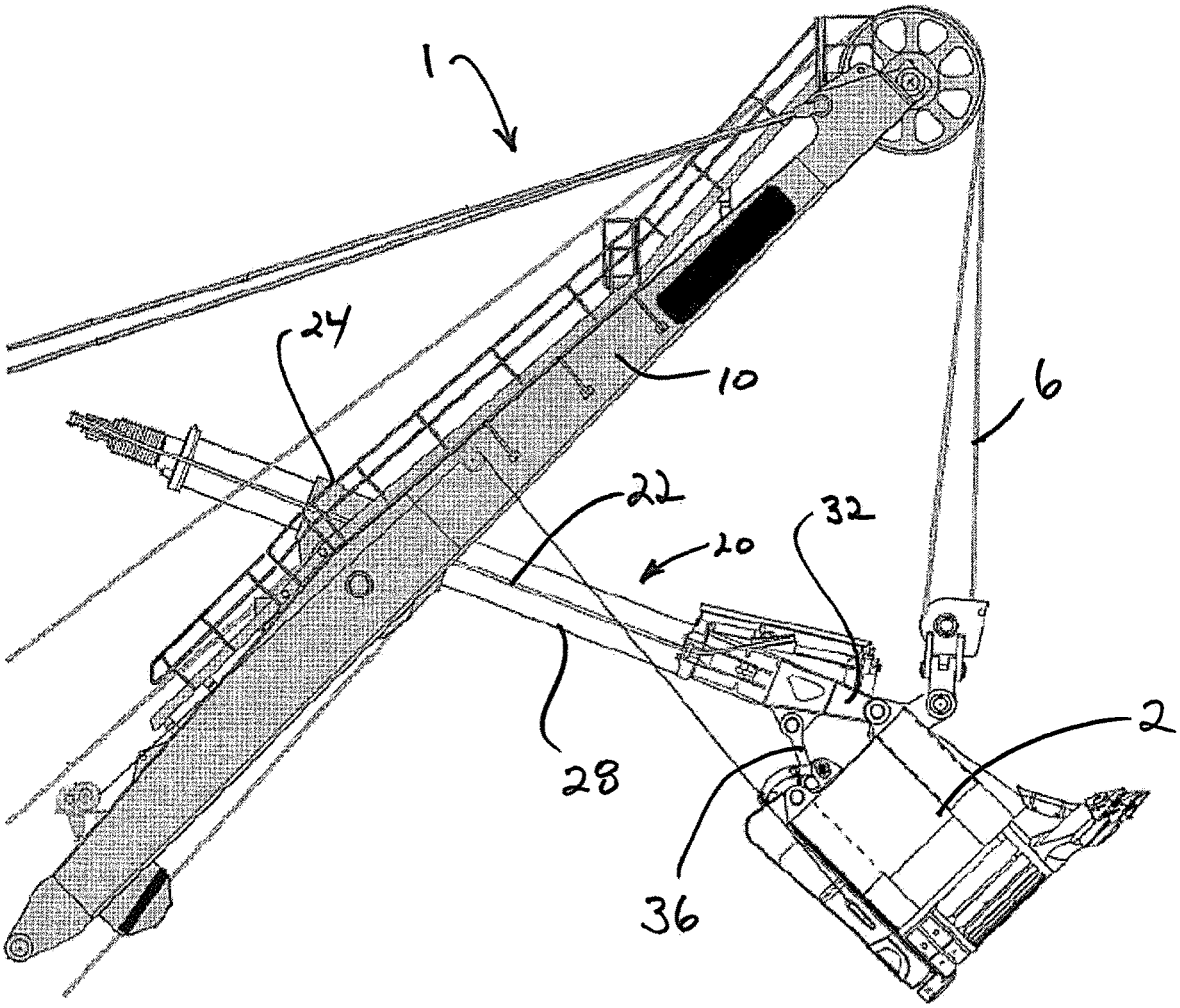
FIG. 1 is an elevation view of a power shovel of the prior art.

The following component list and associated numbering found in the drawings is provided to assist in the understanding of one embodiment of the present invention:

#COMPONENT

1 Power shovel
2 Dipper
6 Cables
10 Boom assembly
20 Dipper handle assembly
22 Rope
24 Saddle block
28 Tube
32 Yoke
36 Pitch brace
50 Handle assembly
54 Yoke
58 Tube
60 D-ring
62 Collar
66 Pin
72 Weld
74 Transition portion
78 Lugs
82 Upper plate
86 Lower plate
90 Outer end of the transition portion
94 Outer end of the transition portion
98 Outer end of the transition portion
102 Outer end of the upper plate
106 Outer end of the lower plate
110 Wrapper plate
114 Lateral edge of the upper plate
118 Lateral edge of the lower plate
122 Side plate
126 Outer end of the side plate
130 Pitch brace lug
140 Insert
144 Aperture
148 Aperture
152 Shoulder
156 Weld It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
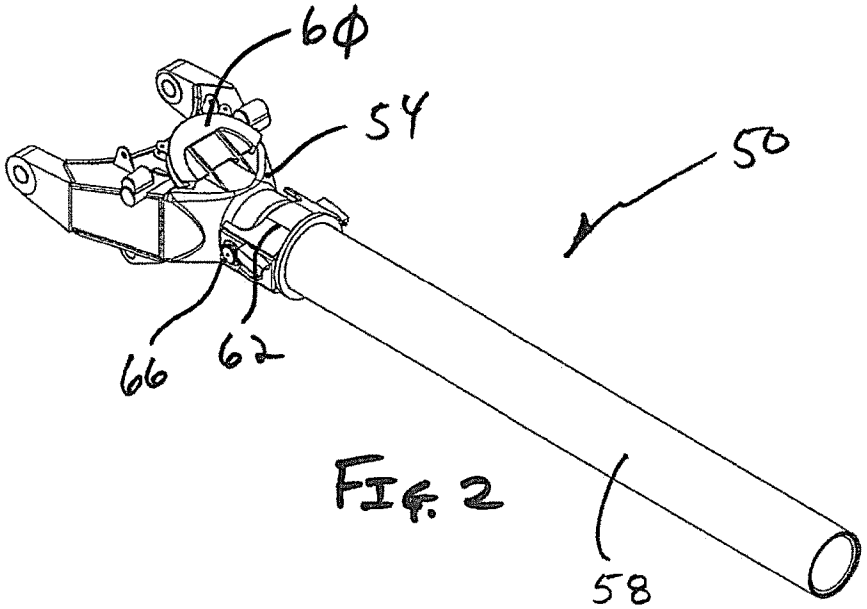
FIG. 2 is a perspective view of a dipper handle assembly of one embodiment of the present invention used by power shovels that employ a rope crowd configuration.
Figure 3:
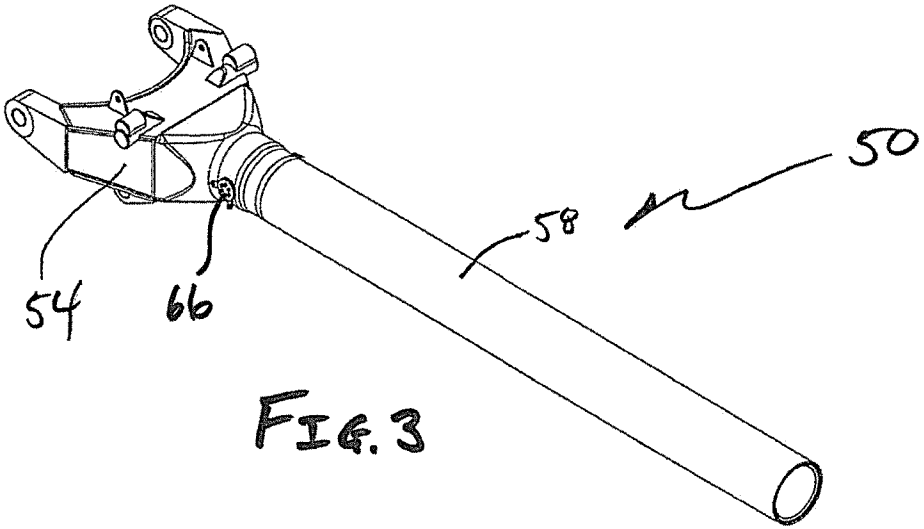
FIG. 3 is a perspective view of a dipper handle assembly of another embodiment of the present invention used by power shovels that employ a hydraulic crowd configuration.
Figure 4:
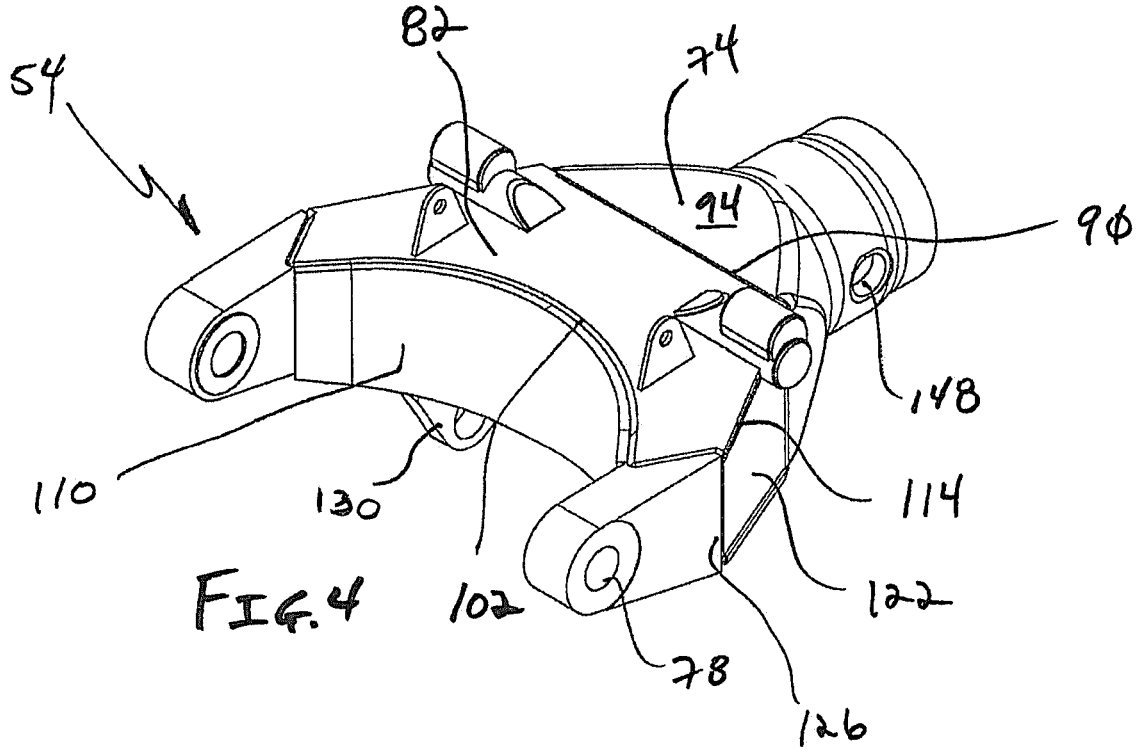
FIG. 4 is a top perspective view of a yoke of one embodiment of the present invention.
Figure 5:
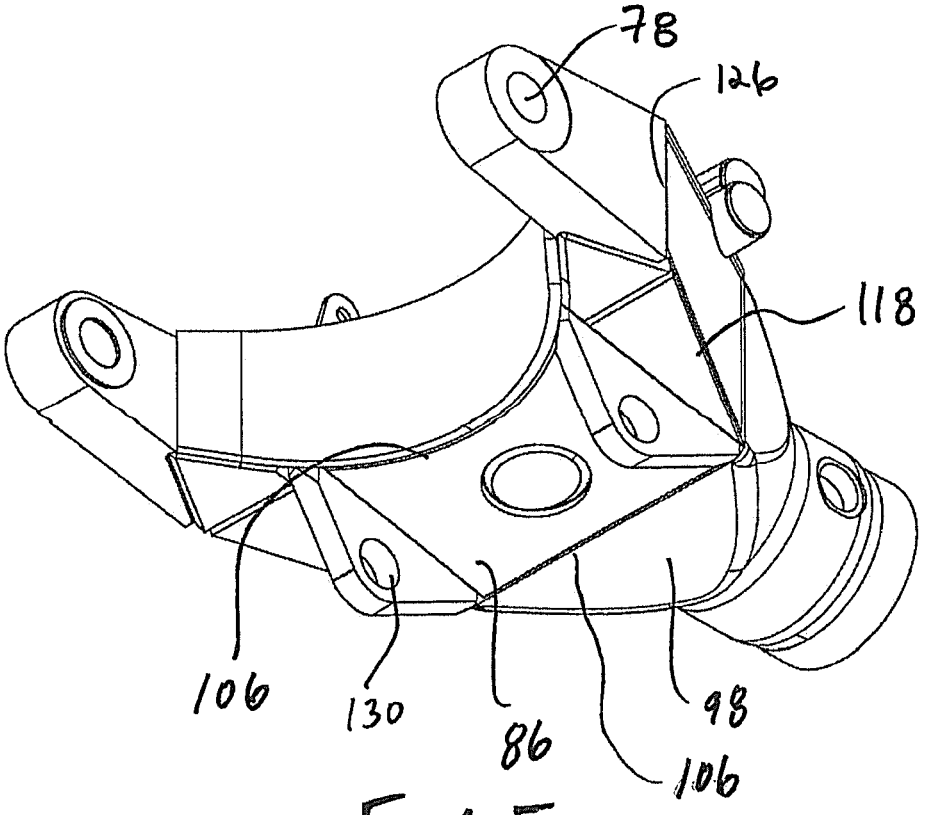
FIG. 5 is a bottom perspective view of a yoke of one embodiment of the present invention.

FIGS. 2-10 show a dipper handle assembly 50 of one embodiment of the present invention that is comprised of a yoke 54 interconnected to one and of a tube 58. FIG. 2 shows one embodiment of the present invention configured to use with rope crowd power shovels, wherein a D-ring 60 or sheave is provided that receives a rope. Here, a collar 62 may also be provided that interconnects the yoke 54 to the tube by way of a pin 66. FIG. 3 shows another configuration used with hydraulic crowd power shovels, wherein a hydraulic cylinder extends the length of the tube and connects to the yoke through an aperture by way of a pin, which will be described in further detail below.

FIGS. 4-8 show the yoke 54 of one embodiment of the present invention. The yoke is comprised of a transition portion 74, which is interconnected to the tube 58 with a full-thickness weld 72. The transition portion 74 is interconnected to a series of interconnected plates that accommodate lugs 78. More specifically, an upper plate 82 and a lower plate 86 are interconnected to an outer end 90 of the transition. The upper plate 82 and the lower plate 86 are also generally coincident with an upper surface 94 and a lower surface 98 of the transition, respectively. Outer ends 102, 106 of the upper plate 82 and the lower plate 86 are interconnected to a wrapper plate 110. The wrapper plate 110 is unique to some embodiments of the present invention and eliminates troublesome cross bracing found in traditional yoke designs. Cross bracing requires constant monitoring and crack repair, while the wrapper plate provides equivalent stiffness and removes the difficult to access weld joint that is prone to cracking. Lateral edges 114 and 118 of the upper plate and the lower plate, respectively, are interconnected to side plates 122, which are also interconnected to the transition's outer end 90. Finally, lugs 78 are interconnected to outer ends 126 of the side plates and outer ends 102, 106 of the upper and lower plates. As one of ordinary skill in the art will appreciate, the upper and lower plates may also include necessary components that interface with lifting and moving devices of the power shovel. For example, the lower plate may accommodate one or more pitch brace lugs 130.

Figure 6:
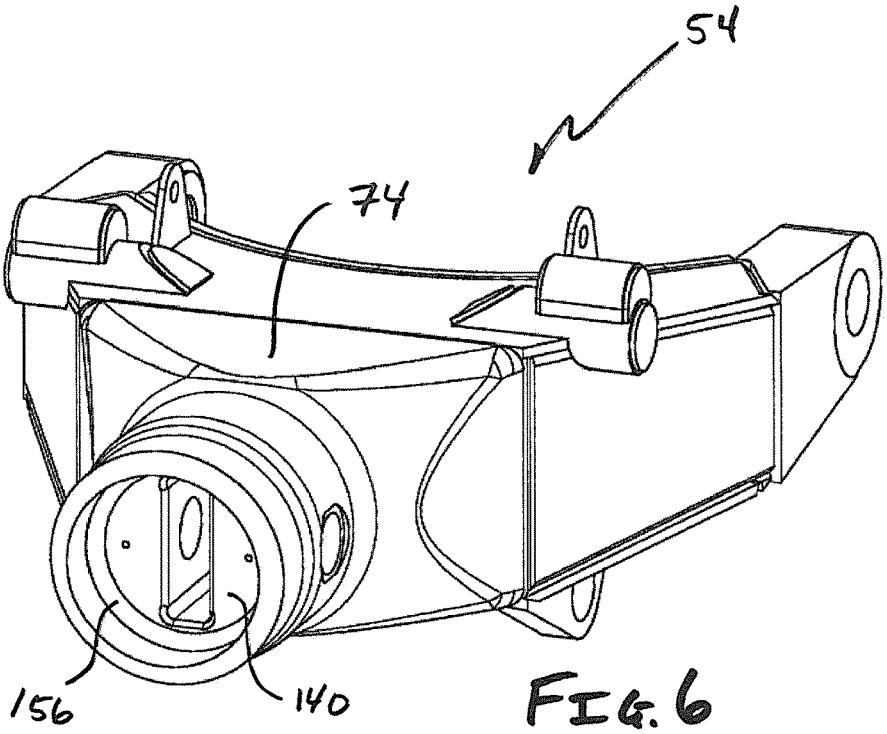
FIG. 6 is a rear perspective view of a yoke of one embodiment of the present invention.
Figure 7:
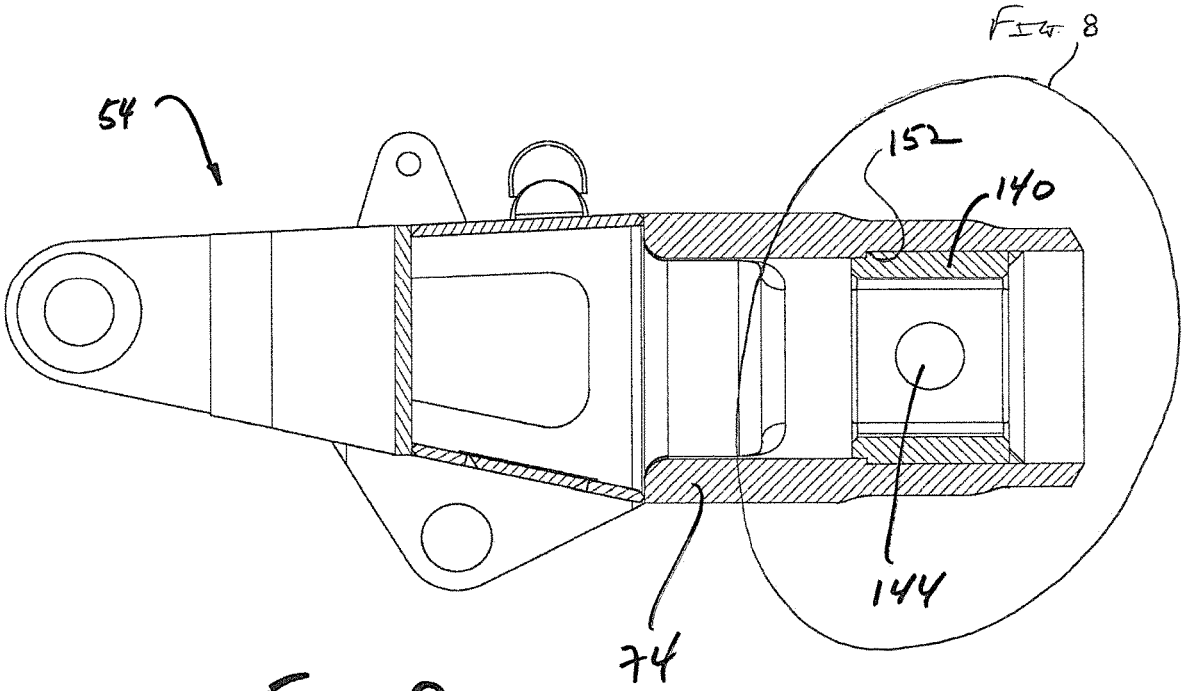
FIG. 7 is a longitudinal cross-sectional view of a yoke of one embodiment of the present invention.
Figure 8:
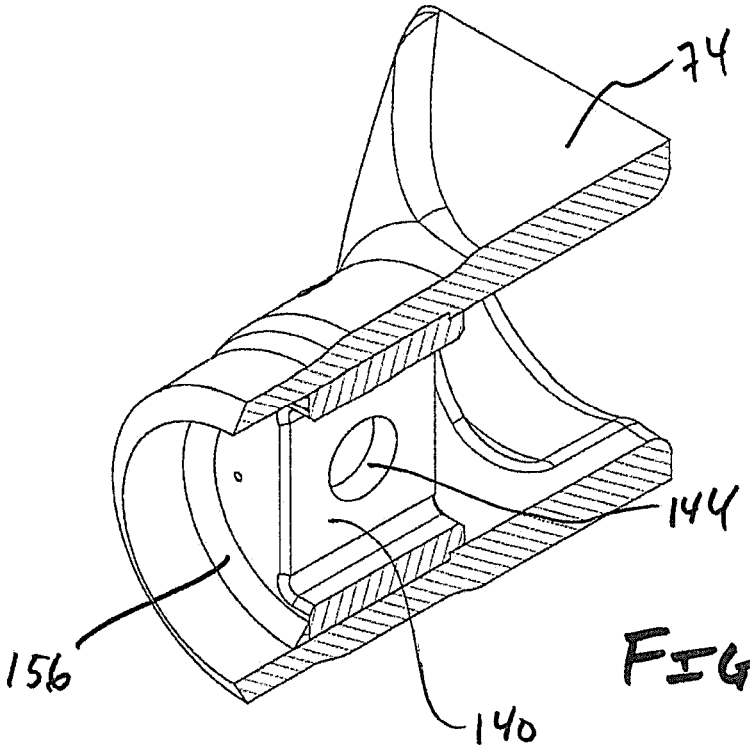
FIG. 8 is a detailed view of FIG. 7.
Figure 9:
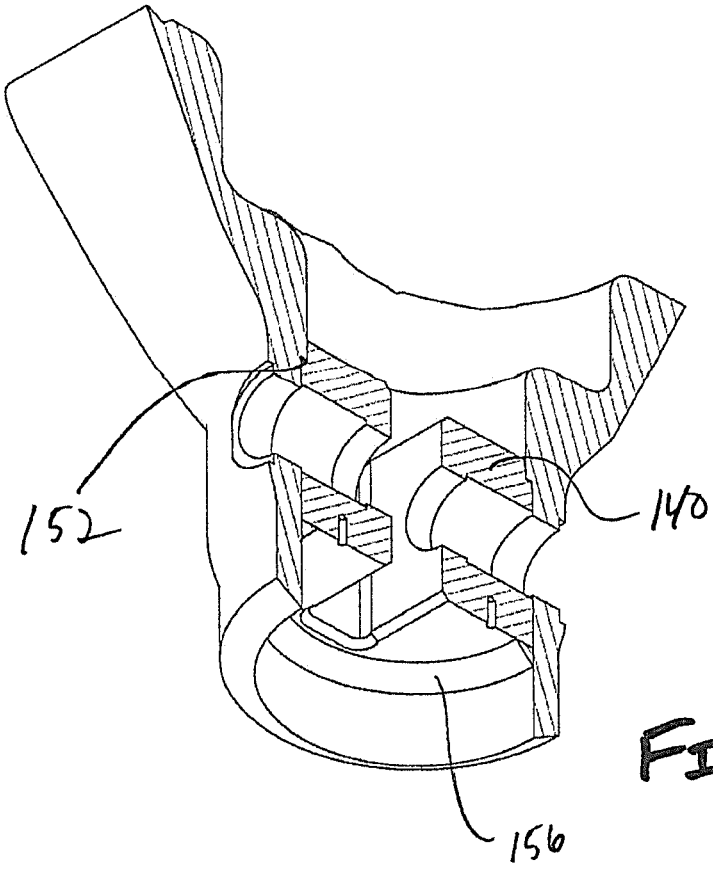
FIG. 9 is a transverse cross-sectional view of FIG. 6.

FIGS. 6-8 are cross-sectional views of a yoke of one embodiment of the present invention that employs an insert 140 that selectively receives an end of a hydraulic piston. The insert has an aperture 144 that corresponds with an aperture 148 in the transition portion 74 (see FIG. 4, for example). These apertures receive a pin 66 that receives the end of the hydraulic piston. In this embodiment, the pin 66 receives retainers at each end. The retainers may have a plurality of tabs for the receipt of a harness. The insert is abutted against the shoulder 152 provided by the transition portion 74, wherein an outer end of the insert 140 is welded 156 to an inner surface of the transition portion. As the transition portion and inner surface of are each made of the same forged material, the weld 156 is not affected by material difference concerns.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A dipper handle assembly, comprising:
a tube with a first end and a second end;
a yoke comprising:
a transition portion interconnected to the first end of the tube,
an upper plate interconnected to an outer end of the transition and generally coincident with an upper surface of the transition,
a lower plate interconnected to an outer end of the transition and generally coincident with a lower surface of the transition,
a wrapper plate interconnecting an outer end of the upper plate and an outer end of the lower plate,
a substantially planar first side plate interconnected to a first lateral end of the upper plate, a first lateral end of the lower plate, and a first lateral end of the transition;
a substantially planar second side plate interconnected to a second lateral end of the upper plate, a second lateral end of the lower plate, and a second lateral end of the transition;
a first lug interconnected to a first lateral end of the wrapper plate, an outer end of the substantially planar first side plate, the outer end of the upper plate, and the outer end of the lower plate;
a second lug interconnected to a second lateral end of the wrapper plate, an outer end of the substantially planar second side plate, the outer end of the upper plate, and the outer end of the lower plate;
a first pitch brace lug interconnected to the lower plate; and
a second pitch brace lug interconnected to the lower plate and spaced from the first pitch brace.

2. The assembly of claim 1, wherein the transition portion is made of forged material.

3. The assembly of claim 1, further comprising an insert positioned within the transition portion.

4. The assembly of claim 1, wherein the transition portion has an aperture therethrough.

5. The assembly of claim 4, further comprising a collar located about a portion of the transition portion, the collar being interconnected to the transition portion by a pin that interfaces with the aperture.

6. The assembly of claim 1, wherein the transition portion of the yoke is at least partially hollow.

7. The assembly of claim 1, wherein the wrapper plate is arcuate.

8. A dipper handle assembly, comprising:
a tube with a first end and a second end;
a yoke comprising:
a transition portion interconnected to the first end of the tube,
an upper plate interconnected to an outer end of the transition,
a lower plate interconnected to an outer end of the transition,
a wrapper plate interconnecting an outer end of the upper plate and an outer end of the lower plate,
a substantially planar first side plate interconnected to a first lateral end of the upper plate, a first lateral end of the lower plate, and a first lateral end of the transition, and a substantially planar second side plate interconnected to a second lateral end of the upper plate, a second lateral end of the lower plate, and a second lateral end of the transition;

a first lug interconnected to a first lateral end of the wrapper plate, an outer end of the substantially planar first side plate, the outer end of the upper plate, and the outer end of the lower plate; and a second lug interconnected to a second lateral end of the wrapper plate, an outer end of the substantially planar second side plate, the outer end of the upper plate, and the outer end of the lower plate.

9. The assembly of claim 8, further comprising an insert positioned within the transition portion.

10. The assembly of claim 8, wherein the transition portion has an aperture therethrough.

11. The assembly of claim 10, further comprising a collar located about a portion of the transition portion, the collar being interconnected to the transition portion by a pin that interfaces with the aperture.

12. The assembly of claim 8, further comprising a first pitch brace lug interconnected to the lower plate; and a second pitch brace lug interconnected to the lower plate and spaced from the first pitch brace.

13. The assembly of claim 8, wherein the transition portion is made of forged material.

14. A power shovel, comprising:

a boom assembly;

a saddle block interconnected to the boom assembly; and a dipper handle assembly operably interconnected to the saddle block, the dipper handle assembly comprising:

a tube with a first end and a second end; and a yoke comprising:

a transition portion interconnected to the first end of the tube, an upper plate interconnected to an outer end of the transition, a lower plate interconnected to an outer end of the transition, a wrapper plate interconnecting an outer end of the upper plate and an outer end of the lower plate, a substantially planar first side plate interconnected to a first lateral end of the upper plate, a first lateral end of the lower plate, and a first lateral end of the transition, and a substantially planar second side plate interconnected to a second lateral end of the upper plate, a second lateral end of the lower plate, and a second lateral end of the transition;

a first lug interconnected to a first lateral end of the wrapper plate, an outer end of the substantially planar first side plate, the outer end of the upper plate, and the outer end of the lower plate; and a second lug interconnected to a second lateral end of the wrapper plate, an outer end of the substantially planar second side plate, the outer end of the upper plate, and the outer end of the lower plate.

15. The power shovel of claim 14, wherein the yoke further comprises a first pitch brace lug interconnected to the lower plate;

a second pitch brace lug interconnected to the lower plate and spaced from the first pitch brace; and wherein the first lug and the second lug are operatively interconnected to an upper portion of a dipper bucket, and the first pitch brace and the second pitch brace are operatively interconnected to a bottom portion of the dipper bucket.

16. The assembly of claim 15, wherein the transition portion of the yoke has an aperture therethrough.

17. The assembly of claim 16, further comprising a collar located about a portion of the transition portion, the collar being interconnected to the transition portion by a pin that interfaces with the aperture.

18. The assembly of claim 15, wherein the transition portion of the yoke is made of forged material.

19. The assembly of claim 15, wherein the yoke is further comprised of an insert positioned within the transition portion.

* * * * *